US008012045B2

(12) United States Patent
Turner

(10) Patent No.: US 8,012,045 B2
(45) Date of Patent: Sep. 6, 2011

(54) GOLF CLUB FITTING SYSTEM AND METHOD

(76) Inventor: Jay Turner, Seattle, WA (US)

( * ) Notice: Subject to any disclaimer, the term of this patent is extended or adjusted under 35 U.S.C. 154(b) by 117 days.

(21) Appl. No.: 12/002,310

(22) Filed: Dec. 14, 2007

(65) Prior Publication Data

US 2010/0004074 A1 Jan. 7, 2010

Related U.S. Application Data

(60) Provisional application No. 60/875,214, filed on Dec. 14, 2006.

(51) Int. Cl.
*A63B 69/36* (2006.01)

(52) U.S. Cl. ..... 473/409; 473/257

(58) Field of Classification Search ..... 473/218, 473/238, 243, 266, 270, 272, 273, 409
See application file for complete search history.

(56) References Cited

U.S. PATENT DOCUMENTS

| | | | | |
|---|---|---|---|---|
| 4,137,566 | A * | 1/1979 | Haas et al. | 473/209 |
| 6,086,483 | A * | 7/2000 | Brown | 473/218 |
| 6,565,448 | B2 * | 5/2003 | Cameron et al. | 473/131 |
| 6,760,685 | B2 * | 7/2004 | Boehm | 702/182 |
| 6,779,277 | B2 * | 8/2004 | Sones | 33/508 |
| 7,153,215 | B2 * | 12/2006 | Peterson et al. | 473/199 |
| 7,250,005 | B2 * | 7/2007 | Wood et al. | 473/282 |
| 2004/0204257 | A1 * | 10/2004 | Boscha et al. | 473/131 |
| 2005/0277483 | A1 * | 12/2005 | Peterson et al. | 473/282 |
| 2008/0076605 | A1 * | 3/2008 | Horn | 473/409 |
| 2008/0235934 | A1 * | 10/2008 | Burnett et al. | 29/557 |

OTHER PUBLICATIONS

Inside Golf Newspaper (aka NW Golf), Seattle-based RedBird Sports comes up with new approach, Sep. 2006 issue, 1 page.

* cited by examiner

*Primary Examiner* — Nini Legesse
(74) *Attorney, Agent, or Firm* — Paul F. Rusyn; Graybeal Jackson LLP

(57) ABSTRACT

A method and system of fitting golf clubs to a person includes generating a dimensional reference number from a golfer's physical characteristics and applying an algorithm to determine desired parameters of golf clubs for the golfer from the dimensional reference number.

12 Claims, 3 Drawing Sheets

GOLF CLUB FITTING SYSTEM AND METHOD

PRIORITY CLAIM

This application claims the benefit under 35 USC §119 of U.S. provisional patent application No. 60/875,214, filed Dec. 14, 2006, which is incorporated herein by reference in its entirety.

TECHNICAL FIELD

The present invention relates generally to the game of golf, and more specifically to devices and methods related to the sizing or fitting of golf clubs for a particular golfer.

BACKGROUND OF THE INVENTION

When golf clubs were first available, they were made in only one size dimension. The manufacturers of that time believed that the "one size fits all" philosophy was valid. Unfortunately, these golf clubs only addressed a very small portion of the population properly. Individuals that were about 5'7"-5'9" were considered the target height. Some years later, manufacturers added an inch long or short to their offerings to accommodate more people. Ladies lengths were typically an inch shorter than the men's lengths. The way a golf club fit was solely based on a person's height.

Then in the early 80's, it became apparent that height shouldn't be the only factor used to determine the specifications of a golf club for a particular individual. Karsten Manuf. Corp. (PING) introduced a chart or measuring ruler that was based on how far one's fingertips were from the floor. They also factored height into the equation to determine what dimensions (i.e. lie and length) a club should have to fit a person properly. Many companies copied or modified this idea and offshoots were developed such as measuring wrist or fist to floor.

The fitting systems above had major shortcomings in that they didn't take into account the major angles created by person in an address position nor did they take into account the individual physical properties of a person such as their leg length, torso length, arm length, shoulder width, etc.

The next major fitting method introduced in the late eighties was the dynamic method. This method involved applying tape to the bottom of the golf club. The golfer then made swings with various clubs with different lies and lengths until they found one that made a mark on the tape in the center of the sole. The inherent problems with this method are twofold. First, flaws present in a player's golf swing directly influenced the fit of the club. In order for clubs fitted in this manner to function properly, the swing flaws present during the fitting process need to be present to the same degree. Unless a golfer's swing is perfect and he doesn't need to correct anything, which is highly unlikely, the club will not promote a proper motion, but will promote the problems. The second problem is that most golfers do not swing the club the same way from one day to the next, let alone one swing to the next. This brings inconsistency as a factor into the fitting process. Currently, many manufacturers that claim to offer custom fitting, are applying the dynamic method or a variation of this method.

Currently, the way a golfer is fit for golf clubs is through observation of overall height and the measurement of fingertips, fists or wrists to floor. This determines the length of the club. Then the golfer proceeds to what is called the dynamic fitting part. This involves the golfer through trial and error, swinging various clubs of different lies and length that have a piece of tape on the bottom of the sole of the club, until he hits one where the tape is marked in the center of the sole. This method introduces inconsistency because amateur golfers tend to swing the club a little differently every time. Therefore, the fitting results are biased by this flawed golf club swing motion.

There is a need for a better way of properly fitting golf clubs to a golfer.

SUMMARY OF THE INVENTION

According to one aspect of the present invention, a method includes generating a dimensional reference number from a golfer's physical characteristics and applying an algorithm to determine desired parameters of golf clubs for the golfer from the dimensional reference number.

DETAILED DESCRIPTION OF PREFERRED EMBODIMENTS

Embodiments of the present invention are directed to a static system using correlated proportional data that takes into account a person's relevant static physical dimensions that are then factored for dynamic changes that should occur during a sound golf swing. This provides a golf club that fits a person's physical size while taking into account the changes that occur during the swinging motion.

In the following description, certain details are set forth in conjunction with the described embodiments of the present invention to provide a sufficient understanding of the invention. One skilled in the art will appreciate, however, that the invention may be practiced without these particular details. Furthermore, one skilled in the art will appreciate that the example embodiments described below do not limit the scope of the present invention, and will also understand that various modifications, equivalents, and combinations of the disclosed embodiments and components of such embodiments are within the scope of the present invention. Embodiments including fewer than all the components of any of the respective described embodiments may also be within the scope of the present invention although not expressly described in detail below. Finally, the operation of well known components and/or processes has not been shown or described in detail below to avoid unnecessarily obscuring the present invention.

In formulating a system and method according to one embodiment of the present invention, tour players of various proportions were used in order to determine appropriate torso tilt, leg flexes, and final ball position. The results were used to create model references to properly fit the average golfer. These factors were included in an algorithm. Then two dynamic factors were utilized. The golf club effectively shortens when it is put in motion. Also, the golfer's body effectively becomes taller at impact position from the set up position. Professional golfers were studied in order to determine the amount of change that occurs from a static address position to a dynamic impact position. A common change factor was found and that factor was also incorporated into the algorithm. Utilizing these factors, a final algorithm was developed that can effectively determine the proper length and lie angle of a golf club that would fit each golfer based on their physical proportions.

A dimensional fitting system (DFS) according to one embodiment of the present invention was developed using all results that the algorithm produced. This embodiment is a simple, easy-to-use device with proprietary dimensional reference numbers that correlate to specific length and lie angle combinations for golf clubs.

Figure 1:
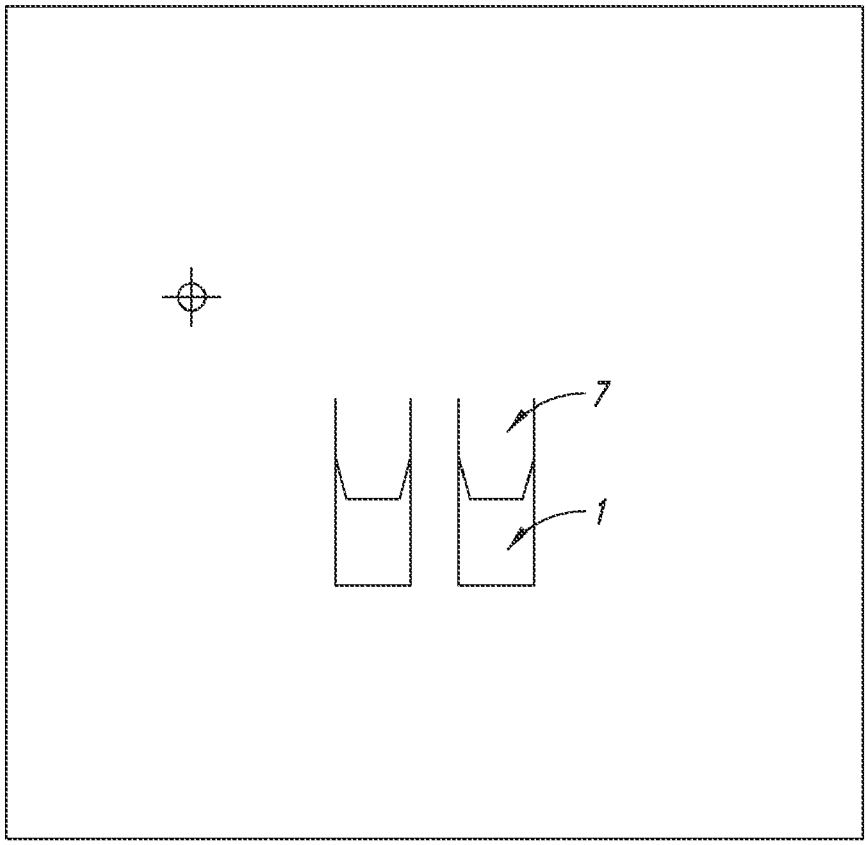
FIGS. 1-3 illustrate a fitting system and method according to embodiments of the present invention.
Figure 2:
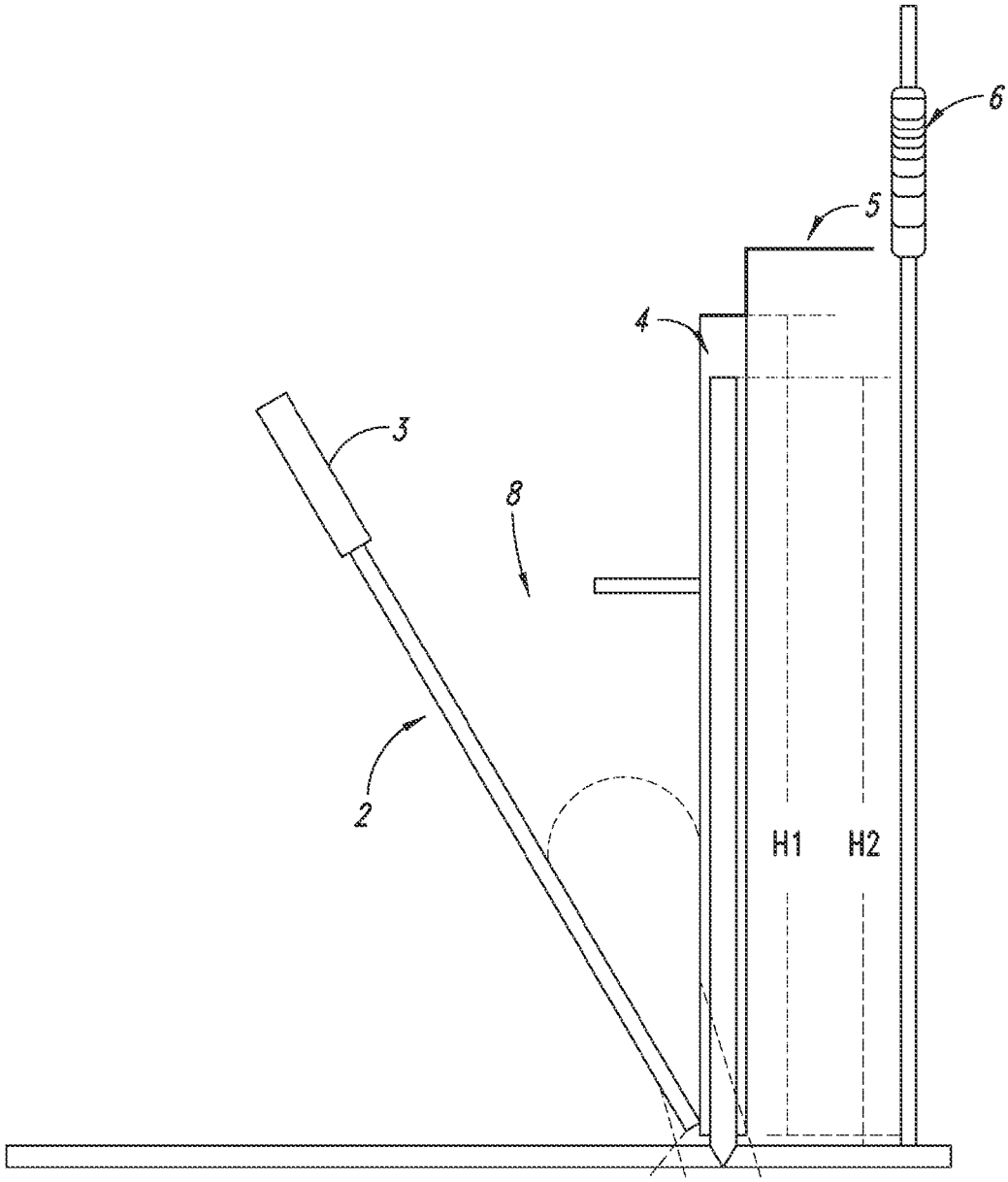
Figure 3:
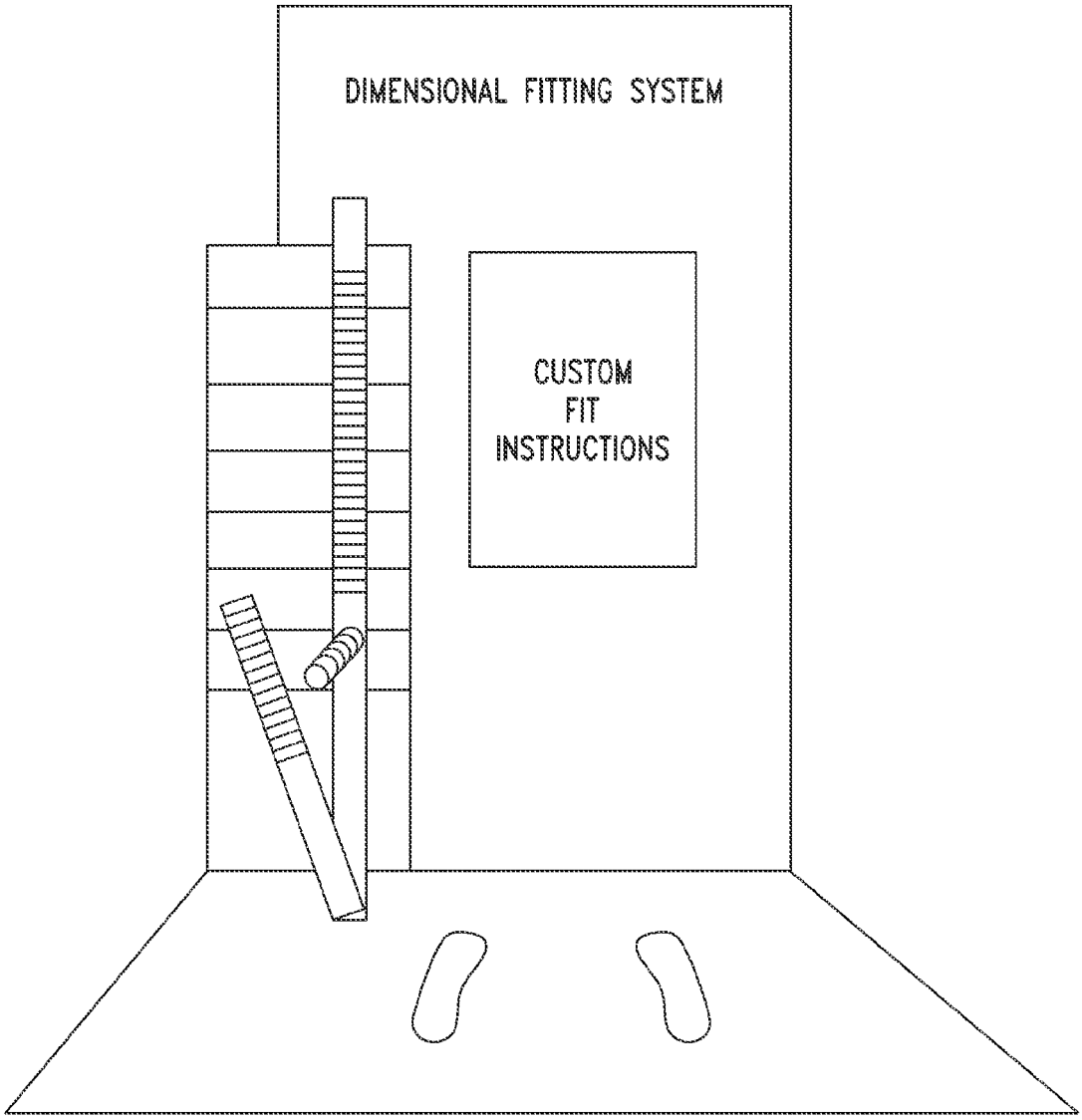

In one embodiment, the device utilizes two handles positioned at different angles, which are attached to a vertically sliding bar as shown in the attached FIGS. 1-3. An attached pointer reads a dimensional reference number that gives the golfer their optimum length and lie angle combination. This will now be described in more detail with reference to FIGS. 1-3. A person (not shown) stands on the provided platform with their heels positioned within heel prints 1. Then they grab an angled bar 2 with their left hand, placing their pinkie finger in a groove on a grip handle 3. Gripping the handle 3, they stand erect with their shoulders level and their arm hanging straight down. A bar mechanism 4 slides vertically upward as a result. There is an indicator stick 5 that is attached to the bar mechanism 4 that also slides upward as the person stands erect. When the person is in the fully erect, correct position, the indicator stick 5 points at a number on a dimensional reference chart 6. The person will note the number given. The person will then repeat the same procedure while positioning their heels within heel prints 7, grabbing a horizontal handle bar 8 and noting the number given by the indicator stick 5 again. The two numbers should be the same or within one of each other. An average is taken and this is the person's final dimensional reference number. This number correlates to a proprietary formula that determines the proper length and lie angle combination for obtaining a proper fitted golf club for the person.

The embodiments of the fitting system and method illustrated in the figures are superior to any other fitting methodology for several reasons. First, the present system and method is very accurate given that it was designed based on definitive, physical measurements and factored mathematically. This approach obtains results to within 1/10" whereas the best that can be expected currently with other approaches is within 1". Second, a person that follows the present procedure utilizing the fitting device can obtain credible results in just a few minutes on their own. It is virtually a self-service device. Conversely, the other fitting systems require a salesperson to assist by measuring and observing the person for the static portion of the fitting process that brings subjectivity into the picture and the introduction of swing flaws during the dynamic portion of the fitting. There are way too many areas of inconsistency allowed. Finally, the length and lie angle of a golf club are interrelated to one another to obtain the optimum ball spacing and physical address position at the same time.

Major manufacturers build thousands of sets of clubs before they know who specifically the end users are. Embodiments of the present invention are built after the individual golfer's specifications and needs are determined, which enables a third person to fit each golfer with the same precision (fit and quality) previously afforded to only the best professional players.

Embodiments of the present invention include a fitting system and device, which may be referred to as a dimensional fitting system herein, that can be utilized to fit golf clubs to anyone from 4 feet 10 inches tall to 6 feet 10 inches tall. The dimensional fitting system and related device or tool will allow authorized retail dealers to accurately fit club dimensions for golfers.

The system has been thoroughly tested by a range of golfers from petite women to a 280-lb. professional football player. Many professional athletes that come into town seek out embodiments of the present invention and get fitted knowing that they are getting clubs that fit their physical attributes.

The dimensional fitting system is based on a combination of geometric principles and modern proportional theory in conjunction with sound set-up angles and positions of professional and better players. Applicant has developed an algorithm that utilizes all of these dimensional facts.

The results are then dynamically factored to take into account the physical changes that occur during a golf swing. Applicant designed a fitting device that allows a golfer to be properly fit. What is most unique with the fitting device is that it calculates both length and lie angle at the same time. The proper combination of these elements helps maintain optimum ball position and spacing. Applicant correlates this information by way of their proprietary numbering system. Once the golfer calculates his number via the fitting device, shaft type and flex as well as grip size and style are recommended.

Everyone should be fitted for their golf clubs because every person is different. Arm length, torso length, leg length, and hand size, just to name a few, are dimensions that when combined together create a unique profile for that individual player. Players of all ability levels will benefit from the use of properly fitted golf clubs. Clubs that fit poorly will require the player to adjust or compromise to the club which then limits the player's ability to achieve full performance. Individual fitting is far preferable to off-the-rack purchases.

Hybrid clubs made of half-wood and half-iron have a flat face like an iron. The ball does not get up quite as quickly as a wood, but is easier to hit and can actually go farther. What really separates embodiments of this invention from others is the precision with which these clubs are customized. Five different physical measurements are then fed into a mathematical formula to determine what club type and length would fit the customer best.

In the present description one skilled in the art will appreciate that the figures related to the various embodiments are not to be interpreted as conveying any specific or relative physical dimensions, and that specific or relative physical dimensions, if stated, are not to be considered limiting unless the claims expressly state otherwise. Even though various embodiments and advantages of the present invention are set forth in the present description, the above disclosure is illustrative only, and changes may be made in detail and yet remain within the broad principles of the present invention. Therefore, the present invention is to be limited only by the appended claims.

What is claimed is:

1. A method of fitting golf clubs to a person, the method comprising:

in a position of the person, measuring a first grip height off the ground;

in a second position of the person, measuring a second grip height off the ground;

determining an average of the first and second grip height measurements;

from the determined average, determining a proper length and lie angle combination for golf clubs for the person;

wherein the operation of measuring the first grip height off the ground comprises:

positioning the person's feet in a first foot position relative to a guide bar position;

grabbing a grip end of an angled bar also having a far end attached at the guide bar position and having a first lie angle, the angled bar being vertically movable at the end attached at the guide bar position;

standing in an upright position to thereby vertically move the far end of the angled bar; and from the vertical movement of the far end of the angled bar, indicating a first dimensional reference number; and wherein measuring the second grip height off the ground comprises;

positioning the person's feet in a second foot position relative to the guide bar position;

grabbing a grip end of a horizontal bar also having a far end attached at the guide bar position and having a second lie angle, the horizontal bar being vertically movable at the end attached at the first guide bar position;

standing in an upright position to thereby vertically move the far end of the angled bar; and from the vertical movement of the far end of the angled bar, indicating a second dimensional reference number.

2. The method of claim 1 wherein determining an average of the first and second grip height measurements comprises summing the first and second dimensional reference numbers and dividing by two.

3. The method of claim 2 wherein determining a proper length and lie angle combination for golf clubs for the person comprises determining the proper length and lie angle numbers as a function of model reference values calculated from torso tilt, leg flex, and final ball position measurements for a plurality of professional tour golfers.

4. The method of claim 3 wherein determining a proper length and lie angle combination for golf clubs for the person further comprises:

measuring for a plurality of professional tour golfers, the amount of change that occurs in the length of a golf club between a static address position and a dynamic impact position, and the amount of change that occurs in a height of a golfer between the static address position and the dynamic impact position;

from these plurality of measured changes, determining a common change factor; and utilizing the common change factor in determining the proper length and lie angle combination for the golf clubs.

5. A method of manufacturing custom golf clubs for a person, the method comprising:

in a first position of the person, measuring a first grip height off the ground;

in a second position of the person, measuring a second grip height off the ground;

determining an average of the first and second grip height measurements;

from the determined average, determining a proper length and lie angle combination for golf clubs for the person; and manufacturing golf clubs having determined length; and wherein the operation of measuring the first grip height off the ground comprises:

positioning the person's feet in a first foot position relative to a guide bar position;

grabbing a grip end of an angled bar also having a far end attached at the guide bar position and having a first lie angle, the angled bar being vertically movable at the end attached at the guide bar position;

standing in an upright position to thereby vertically move the far end of the angled bar; and from the vertical movement of the far end of the angled bar, indicating a first dimensional reference number; and wherein measuring the second grip height off the ground comprises:

positioning the person's feet in a second foot position relative to the guide bar position;

grabbing a grip end of a horizontal bar also having a far end attached at the guide bar position and having a second lie angle, the horizontal bar being vertically movable at the end attached a the first guide bar position;

standing in an upright position to thereby vertically move the far end of the angled bar; and from the vertical movement of the far end of the angled bar, indicating a second dimensional reference number.

6. The method of claim 5 wherein determining an average of the first and second grip height measurements comprises summing the first and second dimensional reference numbers and dividing by two.

7. The method of claim 6 wherein determining a proper length and lie angle combination for golf clubs for the person comprises determining the proper length and lie angle numbers as a function of model reference values calculated from torso tilt, leg flex, and final ball position measurements for a plurality of professional tour golfers.

8. The method of claim 7 wherein determining a proper length and lie angle combination for golf clubs for the person further comprises:

measuring for a plurality of professional tour golfers, the amount of change that occurs in the length of a golf club between a static address position and a dynamic impact position, and the amount of change that occurs in a height of a golfer between the static address position and the dynamic impact position;

from these plurality of measured changes, determining a common change factor; and utilizing the common change factor in determining the proper length and lie angle combination for the golf clubs.

9. A dimensional fitting system for fitting golf clubs to a person, the system comprising:

a base having a guide bar position adapted to receive a vertical guide bar and having first and second sets of foot placement indicators positioned relative to the guide bar position;

a first angled bar movably attached to the vertical guide bar and having a first lie angle;

a second angled bar movable attached to the vertical guide bar and having a second lie angle;

an indicator stick coupled to the vertical guide bar;

a dimensional reference chart positioned adjacent the indicator stick and configured to provide a dimensional reference indicator when the indicator stick is placed in position responsive to a user placing his or her feet in the either the first or second foot placement indicators, grabbing either the first or second angled bar, and standing upright to vertically move the angled side bar and indicator stick.

10. The dimensional fitting system of claim 9 wherein the first lie angle is approximately 60 degrees and the second lie angle is approximately 90 degrees.

11. The dimensional fitting system of claim 9 further comprising a component operable to utilize first and second dimensional reference indicators provided responsive to the user placing his or feet in the first foot placement indicators and grabbing the first angled bar and placing his or feet in the second foot placement indicators and grabbing the second angled bar, respectively, in combination with model reference values calculated from torso tilt, leg flex, and final ball position measurements for a plurality of professional tour golfers to determine proper length and lie angle of clubs for the user.

12. The dimensional fitting system of claim 11 wherein the component is further operable to utilize a common change factor, which is derived from the amount of change that occurs in the length of a golf club between a static address position and a dynamic impact position and the amount of change that occurs in a height of a golfer between the static address position and the dynamic impact position, to determine the proper length and lie angle combination for the golf clubs.

* * * * *

UNITED STATES PATENT AND TRADEMARK OFFICE

CERTIFICATE OF CORRECTION

PATENT NO. : 8,012,045 B2
APPLICATION NO. : 12/002310
DATED : September 6, 2011
INVENTOR(S) : Jay Turner It is certified that error appears in the above-identified patent and that said Letters Patent is hereby corrected as shown below:

- In Claim 1, Column 4, Line 58 of the patent, "in a position of the person, measuring" should read --in a first position of the person, measuring--.

-- In Claim 5, Column 6, Line 15 of the patent, "vertically movable at the end attached a the first" should read --vertically movable at the end attached at the first--.

Signed and Sealed this
Eighth Day of November, 2011

David J. Kappos

David J. Kappos
*Director of the United States Patent and Trademark Office*